United States Patent [19]

Huber

[11] 4,077,519

[45] Mar. 7, 1978

[54] CURL DETECTOR AND SEPARATOR

[75] Inventor: Charles L. Huber, Marion, N.Y.

[73] Assignee: Xerox Corporation, Stamford, Conn.

[21] Appl. No.: 781,891

[22] Filed: Mar. 28, 1977

[51] Int. Cl.[2] ..... B65H 29/58

[52] U.S. Cl. ..... 209/74 R; 271/64; 271/193

[58] Field of Search ..... 271/64, 172, 193, 194; 209/74

[56] References Cited

U.S. PATENT DOCUMENTS

| | | | |
|---|---|---|---|
| 3,970,381 | 7/1976 | Meagher | 271/193 X |
| 3,991,995 | 11/1976 | Su | 271/193 X |

*Primary Examiner*—Richard A. Schacher

[57] ABSTRACT

A device to predetermine the stripability of a sheet of copy paper being processed in a xerographic reproduction machine to prevent processing of those sheets that would be difficult to strip subsequent to transfer.

6 Claims, 2 Drawing Figures

CURL DETECTOR AND SEPARATOR

BACKGROUND OF THE INVENTION

In conventional xerography, a xerographic suface comprising a layer of photoconductive insulating material affixed to a conductive backing is used to support latent electrostatic images. In the process, the xerographic surface is electrostatically charged and the charged surface is then exposed to a light pattern of the image being reproduced to thereby discharge the surface in the areas where the light strikes the surface. The undischarged areas of the surface thus form an electrostatic charge pattern in conformity with the configuration of the original pattern.

The latent electrostatic image may then be developed by contacting it with a finely divided electrostatically attractable material, ordinarily a pigmented resinous powder, referred to herein as "toner." The toner particles are attracted to the electrostatic image from the carrier to produce a visible toner image on the xerographic surface.

After the image is developed, a transfer member, ordinarily copy paper, is caused to move in synchronized contact with the photoconductive surface. During this time an electrical potential opposite from the polarity on the toner is applied to the side of the paper remote from the photoconductive surface to electrostatically attract the toner image from the xerographic surface to the copy paper. The copy paper, which is an insulator, retains the charge while inducing a reverse charge on the non-discharged ares of the xerographic surface. This charge orientation creates an electrostatic bond between the paper and the xerographic surface. Removal of the copy sheet which is electrostatically bonded to the surface, without disturbing the toner image loosely adhering thereto, has long been a problem in the xerographic art.

In order to separate the copy sheet from the xerographic surface, the charge on the copy sheet may be neutralized or reduced with a corona discharge device while the sheet is on the xerographic surface. Assuming the copy sheet is partially neutralized thereby, a vacuum stripping device may be employed for pulling the leading edge of the copy sheet from the xerographic surface for subsequent movement of the copy sheet away from the xerographic surface by a suitable paper transport.

Stripping of the copy sheet from the xerographic surface may be further complicated by an inherent curl in the copy sheet which causes it to conform to the curved surface of the photoreceptor such that the beam strength of the paper cannot be relied upon to aid in the stripping process. It has been found that this inherent curl is variable from sheet to sheet within a stack of sheets from the paper supply tray.

It is therefore an object of the present invention to subject each sheet supplied from the paper supply tray to conditions similar to the conditions existing downstream from the transfer area whereat the copy paper with the transferred image thereon is stripped from the photoreceptor and to remove sheets from the paper path which will in all probability create problems at the stripping area.

SUMMARY OF THE INVENTION

The present invention relates to a reproduction machine wherein each copy sheet is tacked to a rotating curl detection roll and thereafter stripped therefrom to determine the stripability of each sheet prior to presentation of the sheet to the transfer area of the machine to assure stripping of the sheet at the transfer area.

DESCRIPTION OF THE PREFERRED EMBODIMENT

Figure 1:
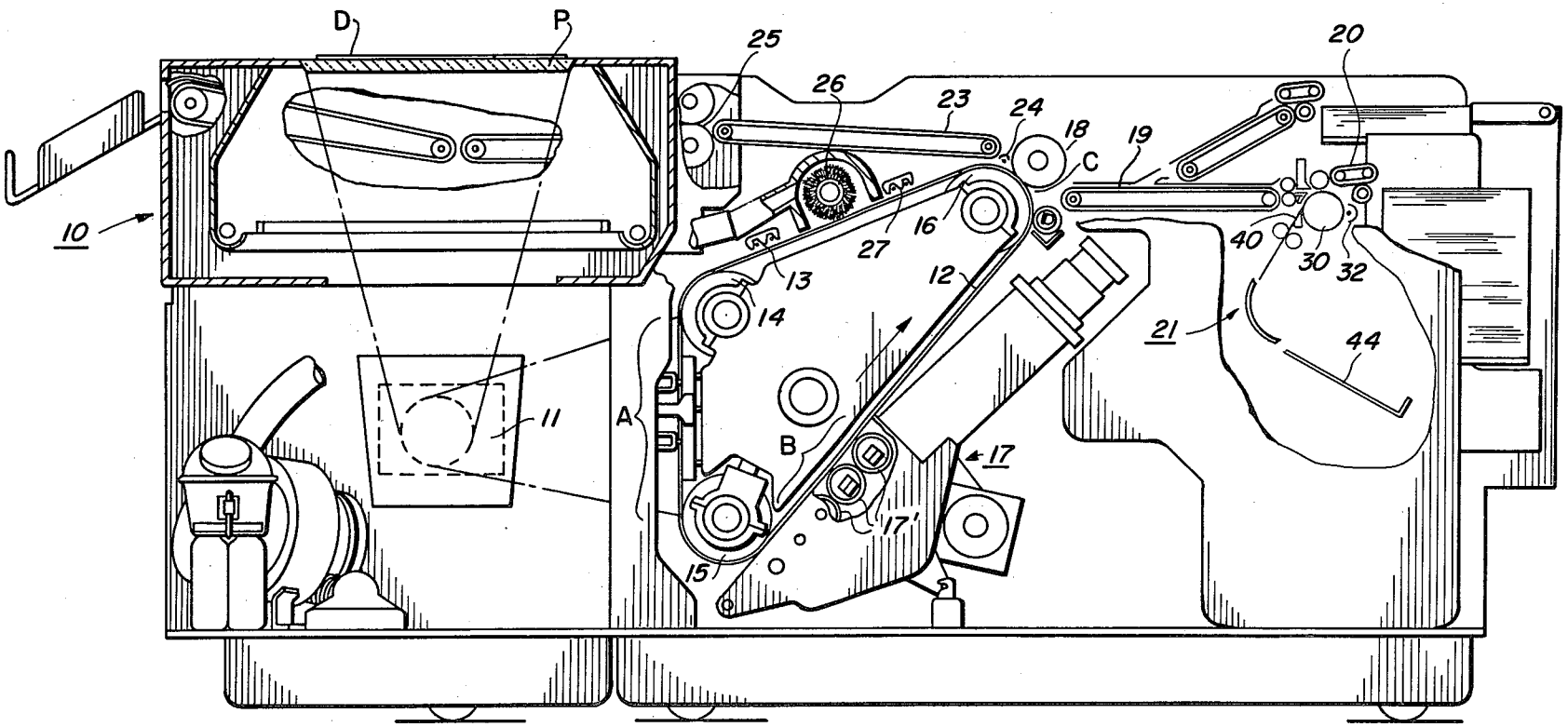
FIG. 1 is a schematic sectional view of an electrostatic reproduction machine embodying the principles of the present invention.
Figure 2:
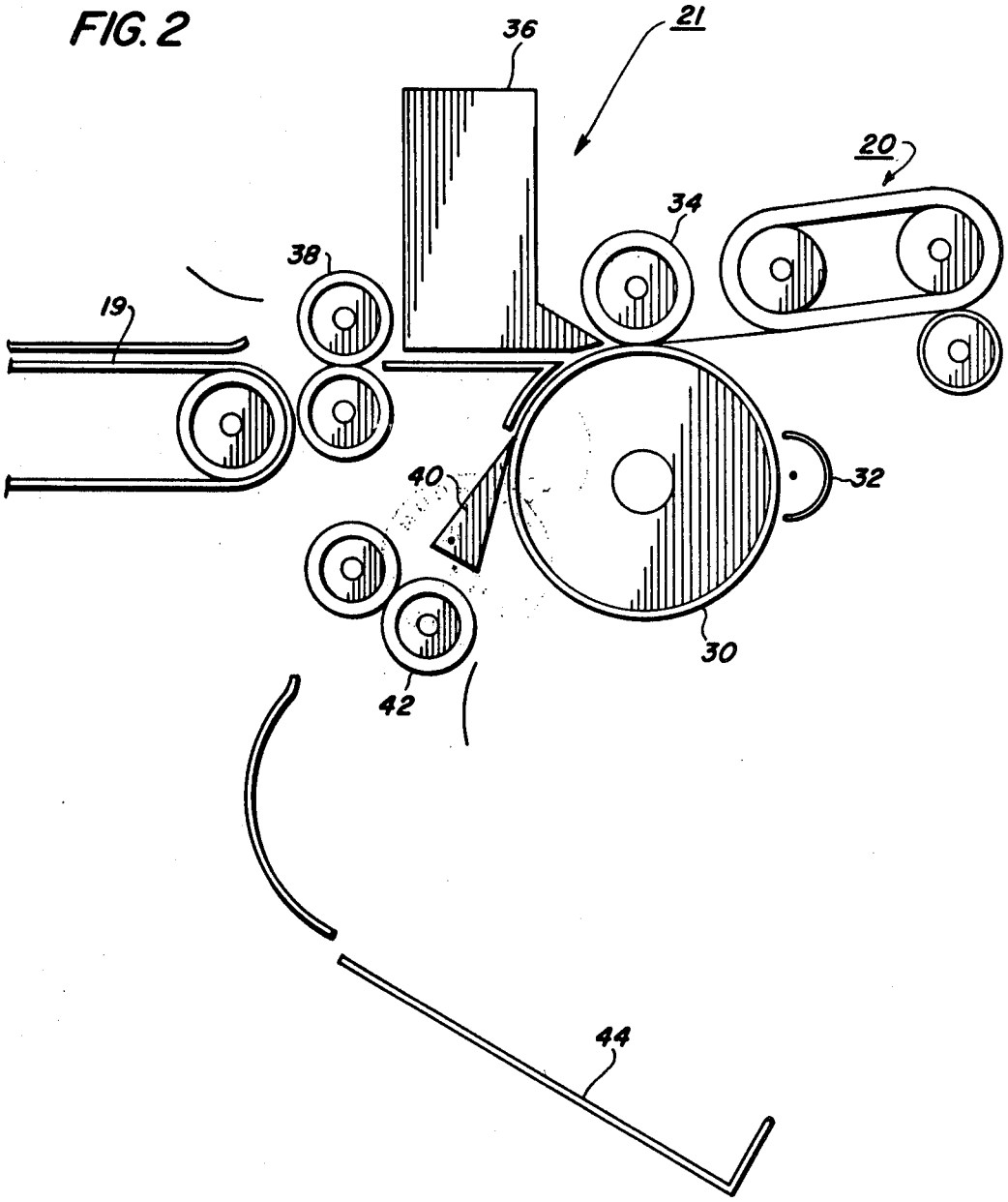
FIG. 2 is an enlarged elevation view in cross section of the curl detection apparatus utilized to predetermine the stripability of each copy sheet fed through the reproduction machine.

For a general understanding of an electrostatic processing system in which the invention may be incorporated, reference is had to FIG. 1. In the illustrated machine, an original D to be copied is placed upon a transparent support platen P fixedly arranged in an illumination assembly generally indicated by the reference numeral 10. While upon the platen, an illumination system flashes light rays upon the original thereby producing image rays corresponding to the informational areas on the original. The image rays are projected by means of an optical system 11 to an exposure station A for exposing the photosensitive surface of a moving xerographic plate in the form of a flexible photoconductive belt 12. In moving in the direction indicated by the arrow, prior to reaching the exposure sation A, that portion of the belt being exposed would have been uniformly charged by a corona device 13 located at a belt run extending between belt supporting rollers 14 and 16. The exposure station extends between the roller 14 and a third support roller 15.

The exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes around the roller 15 and through a developing station B located at a third run of the belt wherein there is positioned a developing apparatus generally indicated by the reference numeral 17. The developing apparatus 17 comprises a plurality of brushes 17' which carry developing material to the adjacent surface of the upwardly moving inclined photoconductive belt 12 in order to provide development of the electrostatic image.

The developed electrostatic image is transported by the belt 12 to a transfer station C located at a point of tangency on the belt as it moves around the roller 16 whereat a sheet of copy paper is moved at a speed in synchronism with the moving belt in order to accomplish transfer of the developed image. There is provided at this station a transfer roller 18 which is arranged on the frame of the machine for contacting the non-transfer side of each sheet of copy paper as the same is brought into transfer engagement with the belt 12. The roller 18 is electrically biased with sufficient voltage so that a developed image on the belt 12 may be electrostatically transferred to the adjacent side of a sheet of paper as the same is brought into contact therewith. There is also provided a suitable sheet transport mechanism 19 adapted to transport sheets of paper seriatim from a paper handling mechanism generally indicated by the reference numeral 20 through a curl detection device 21 to the developed image on the belt as the same is carried around the roller 16. A programming device operatively connected to the mechanism 20 and the illumination device for producing an electrostatic latent image on the belt 12, is effective to present a developed image at the transfer station C in time sequence with the arrival of a sheet of paper.

The sheet is stripped from the belt 12 after transfer of the image thereto by a stripper transport 23 and a detack corona emission device 24, and thereafter conveyed by the stripper transport 23 into a fuser assembly generally indicated by the reference numeral 25 wherein the developed and transferred xerographic powder image on the sheet is permanently affixed thereto. After fusing, the finished copy is discharged from the apparatus at a suitable point for collection externally of the apparatus: The toner particles remaining as residue on the developed image, background particles, and those particles otherwise not transferred are carried by the belt 12 to a cleaning apparatus positioned on the run of the belt between rollers 14 and 16 adjacent the charging device 13. The cleaning device, comprising a rotating brush 26 and a corona emission device 27 for neutralizing charges remaining on the particles, is connected to a vacuum source (not shown) for removing the neutralized toner particles from the belt prior to the formation of subsequent images thereon.

Referring now to FIG. 3, the curl detection device 21 will be more fully explained. The curled detection device 21 comprises a rotating roll 30 preferably of a diamater such that the curvature thereof approximates the curvature of the photoreceptor at the transfer station. A corona emission device 32 is provided to produce a charge on the roll 30 of a magnitude and polarity similar to that on the photoreceptor surface at the transfer station. A charging roll 34 adapted to be maintained at an electrical potential similar to the potential of the transfer roll 18 is provided to assure that the electrical forces acting on the copy sheets passing between roll 34 and roll 30 duplicate as closely as possible the conditions that will exist on the sheet at the transfer station of the xerographic processor. While an electrically biased roll 34 is illustrated, it should be understood that a corona emission device could be utilized to affect a charge on the copy sheet similar to that produced by the electrically biased transfer roll. Immediately downstream from the nip of roll pair 30, 34, there is provided a vacuum stripping plenum 36 which is supplied with a source of vacuum closely approximating that present at the vacuum stripping transport 23.

Assuming the copy sheet passing through the nip of rolls 30, 34, has an "up curl" or substantially flat configuration, vacuum stripper 36 will be sufficient to strip the tacked sheet from roll 30, thereby allowing the sheet to pass between the nip of subsequent transport roll pair 38 onto transport 19 for presentation to the transfer station of the xerographic processor. However, if due to the tacking action of roll pair 30, 34 in conjunction with the curl of the paper, vacuum from stripper 36 is insufficient to strip the sheet from roll 30, the sheet will continue around roll 30 into contact with a mechanical stripper finger 40 which physically removes the sheet from roll 30 to allow passage of the sheet through a roll pair 42 into an abort tray 44. In this way, sheets which if passed through the transfer station of the xerographic processor would be difficult or impossible to strip with the vacuum stripper transport 23, are removed from the paper path to allow subsequent sheets to be presented to the transfer area of the machine and thereby minimize the possibility of mis-strips or paper jams at the transfer area.

It can be seen from the foregoing that with the illustrated device, each copy sheet presented to the machine by the sheet separator 21 is "pretested" for stripability and in the event that a sheet which would be difficult to strip is presented thereto, the sheet is removed from the paper path into the abort tray and damage or jamming of the machine is prevented.

While I have described the preferred embodiment of my invention it is to be understood that the invention is not limited thereby, but may be otherwise embodied within the scope of the following claims:

What is claimed is:

1. A reproduction machine adapted to produce copies on sheet material fed through a plurality of processing stations in the machine, the machine having a sheet curl detection device thereon, the sheet curl detecting device comprising:

a rotatable curl detector roll adapted for contact with each sheet fed through the machine;

charging means adapted to provide an electrical charge on said rotatable roll for electrostatically attracting the fed sheets thereto;

curl detector vacuum stripping means adapted to strip sheets from said roll after the sheets have been attracted thereto to enable passage of the stripped sheets to subsequent processing stations in the machine, and;

mechanical stripping means downstream from said vacuum stripping means to physically remove those sheets from said roll that are not removed by said vacuum stripping means, failure of said vacuum stripping means to strip a sheet being indicative of a sheet curl in the same direction as the curvature of said roll.

2. A reproduction machine according to claim 1 wherein said reproduction machine includes a photoconductor adapted for production of a developed electrostatic latent image thereon;

a transfer station adapted for transferring the developed electrostatic image on said photoconductor to copy sheets fed through said transfer station, said photoconductor assuming an acuate shape at said transfer station, said rotable roll having a radius substantially equal to the radius of the arcuate section of said photoconductor at said transfer station.

3. A reproduction machine according to claim 2 further including a vacuum stripping station downstream from said transfer station adapted to strip the copy sheets from said photoconductor subsequent to the transfer of the developed image thereto, the stripping force exerted on the copy sheets at said stripping station being substantially equal to the stripping force exerted on the sheets by said curl detector vacuum stripping means.

4. A reproduction machine according to claim 3 further including transfer charging means at said transfer station to cause the developed electrostatic image on said photoconductor to be attracted to the copy sheet at said transfer station, and;

sheet charging means disposed adjacent said rotatable curl detector roll to produce a charge on copy sheets contacting said roll substantially equal to the charge produced on the copy sheets by said transfer charging means.

5. A reproduction machine according to claim 1 further including an abort tray for receiving sheets stripped from said curl detector roll by said mechanical stripping means.

6. A reproduction machine according to claim 5 wherein said mechanical stripping means comprises stripper fingers adapted for contact with said curl detector roll for physically removing copy sheets adherent thereto.

* * * * *